US007426927B1

(12) United States Patent
Broersma

(10) Patent No.: US 7,426,927 B1
(45) Date of Patent: Sep. 23, 2008

(54) PAINTBALL MARKER WITH INTERGRATED HOPPER

(75) Inventor: Lester V. Broersma, San Diego, CA (US)

(73) Assignee: J.T. Sports, LLC, Bentonville, AR (US)

( * ) Notice: Subject to any disclaimer, the term of this patent is extended or adjusted under 35 U.S.C. 154(b) by 82 days.

(21) Appl. No.: 11/349,027

(22) Filed: Feb. 7, 2006

Related U.S. Application Data

(60) Provisional application No. 60/652,461, filed on Feb. 11, 2005.

(51) Int. Cl.
*F41B 11/02* (2006.01)

(52) U.S. Cl. ..... 124/49; 124/73

(58) Field of Classification Search ..... 124/45, 124/49, 51.1, 73, 74
See application file for complete search history.

(56) References Cited

U.S. PATENT DOCUMENTS 6,374,819 B1 * 4/2002 Ming-Hsien ..... 124/49
6,481,432 B2 * 11/2002 Rushton et al. ..... 124/49
6,526,955 B1 * 3/2003 Juan ..... 124/49
6,588,412 B2 * 7/2003 Ferrara et al. ..... 124/49
6,729,321 B2 * 5/2004 Ho ..... 124/49
6,915,792 B1 * 7/2005 Sheng ..... 124/48

* cited by examiner

*Primary Examiner*—John Ricci
(74) *Attorney, Agent, or Firm*—Keisling Pieper & Scott PLC; David B. Pieper; Trent C. Keisling

(57) ABSTRACT

An integrated paintball marker having an integrated hopper in the marker body. The integrated hopper is connected by a sliding mechanism and provides for a center of gravity closer to the user's hand as well as reduced extremities for targeting by other players or for catching on foreign objects. The hopper is removable from the body using a connector and lock system that is separate from the exit port and which allows positioning on the marker while blocking the exit port from the hopper compartment.

1 Claim, 16 Drawing Sheets

PAINTBALL MARKER WITH INTERGRATED HOPPER

CROSS-REFERENCE TO RELATED APPLICATIONS

This application claims priority to and is a continuation-in-part of U.S. provisional application Ser. No. 60/652,461, filed Feb. 11, 2005.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of paintball products. In particular, the present invention relates specifically to the integration of a paintball hopper into the body of the paintball marker to lower the center of gravity and reduce the feed length of the paintball path from the hopper into the launching chamber.

2. Description of the Known Art

As will be appreciated by those skilled in the art, paintball hoppers are utilized to feed paintballs to the breech of the paintball marker. Patents disclosing information relevant to paintballs, markers, and hoppers include U.S. Pat. No. 6,845,794, issued to Johnson on Jan. 25, 2005 entitled Paintball filling system; U.S. Pat. No. 6,763,822, issued to Styles on Jul. 20, 2004 entitled Electropneumatic paintball gun, method of making and operating, and retrofit kit assembly; U.S. Pat. No. 6,739,322, issued to Rice et al. on May 25, 2004 entitled Paintball feed system; U.S. Pat. No. 6,701,909, issued to Tiberius et al. on Mar. 9, 2004 entitled Semi-automatic-firing, compressed-gas gun; U.S. Pat. No. 6,658,982, issued to Cherry on Dec. 9, 2003 entitled Cocking knob and striker arrangement for gas-powered projectile firing device; U.S. Pat. No. 6,644,366, issued to Johnson on Nov. 11, 2000 entitled Paintball filling system; U.S. Pat. No. 6,626,165, issued to Bhogal on Dec. 30, 2003 entitled Paintball gun; U.S. Pat. No. 6,574,945, issued to Martinez, Jr. on Jun. 10, 2003 entitled Method for manufacturing a projectile containing chemiluminescent compounds; U.S. Pat. No. 6,481,432, issued to Rushton, et al. on Nov. 19, 2002 entitled Paintball hopper; U.S. Pat. No. 6,470,872, issued to Tiberius et al. on Nov. 19, 2002 entitled Semi-automatic firing compressed-gas gun; U.S. Pat. No. 6,055,975, issued to Gallegher et al. on May 2, 2000 entitled Paintball container; and U.S. Pat. No. 5,722,383 issued to Tippmann, Sr., et al. on Mar. 3, 1998 entitled Impeder for a gun firing mechanism with ammunition feeder and mode selector. Each of these patents is hereby expressly incorporated by reference in their entirety.

U.S. Pat. No. 6,701,909, issued to Tiberius et al. on Mar. 9, 2004 entitled Semi-automatic-firing, has the following description in its abstract: "A paintball gun is sized and designed to appear like and operate in a manner similar to a conventional gun. A dual-action firing bolt moves forward, assisting in launching a projectile, under cast pressure. The bolt then releases the compressed gas to carry the projectile down the barrel. Return springs operate to move the bolt and its valves to a ready-to-fire position. Similarly, trigger actuation mechanisms are spring-actuated to return to the ready-to-fire position. A removable magazine stores projectiles and propellant. The magazine is small enough to fit into a handle of a pistol. A user may selectively release just the projectile portion of the magazine, in order to leave the propellant undisturbed until fully expended. The magazine can be completely removed without substantial loss of propellant."

U.S. Pat. No. 6,481,432, issued to Rushton, et al. on Nov. 19, 2002 entitled Paintball hopper, has the following description in its abstract: "A paintball hopper for connection to a paintball launcher or marker has a counter which includes a flexible potentiometer extending into a transfer conduit that connects to the paintball launcher or marker. The hopper has a reservoir shaped for movement of the paintballs toward the transfer conduit. The hopper has a nose with slanted surfaces that are deflection engineered to enhance the deflectability of paintballs directed at the user. The counter mechanism includes a timer and an LCD display so the user can see how many paintballs have been launched and monitor time. The hopper also includes an agitator to agitate the paintballs in the reservoir."

U.S. Pat. No. 6,470,872, issued to Tiberius et al. on Nov. 19, 2002 entitled Semi-automatic firing compressed-gas gun, has the following description in its abstract: "A paintball gun is sized and designed to appear like and operate in a manner similar to a conventional gun. A dual-action firing bolt moves forward, assisting in launching a projectile, under cast pressure. The bolt then releases the compressed gas to carry the projectile down the barrel. Return springs operate to move the bolt and its valves to a ready-to-fire position. Similarly, trigger actuation mechanisms are spring-actuated to return to the ready-to-fire position. A removable magazine stores projectiles and propellant. The magazine is small enough to fit into a handle of a pistol. A user may selectively release just the projectile portion of the magazine, in order to leave the propellant undisturbed until fully expended. The magazine can be completely removed without substantial loss of propellant."

U.S. Pat. No. 5,722,383 issued to Tippmann, Sr., et al. on Mar. 3, 1998 entitled Impeder for a gun firing mechanism with ammunition feeder and mode selector, has the following description in its abstract: "An ammunition feed mechanism for an automatic or semiautomatic weapon which includes a mechanism for retarding the cyclic feeding of ammunition into the chamber of the weapon. The mechanism for retarding the cyclic feeding of ammunition includes an impeder which engages the bolt of the weapon. The ammunition feed mechanism also includes a magazine having a ramped bottom which directs ammunition projectiles to an exit therein where the ammunition projectiles are fed into the chamber of the weapon. The magazine includes a plurality of curved projections in the bottom which define a plurality of spaces into which the ammunition projectiles are received. The plurality of curved projections also guide the ammunition projectiles through the exit."

Additional prior art is also known. As shown in FIG. 1 of the drawings, it is also currently known to use a separate exterior hopper 14 to feed a paintball 10 into an internal loading area 18 of a separate paintball marker body 16. The majority of prior art designs utilize separate paintball hoppers 14 that are self contained units using a neck extension 20 which is friction fit connected into an external feed neck 22 located on the top or the side of the paintball marker body 16. Clamping grips have also been used on the external feed neck 22. This extended construction which locates the mass of the paintball hopper 14 and any contained paintballs 10 in an extended position above the marker provides a greatly expanded profile 24 which presents a larger target for opposing players. Furthermore, this upward neck extension 20 and 22 and the associated extended mounting of the external hopper 14 causes a higher center of gravity which results in a reduction of control when aiming the marker 16. Thus, the prior art teaches paintball markers and hopper having inherent problems such that an improved hopper and marker are needed to overcome these limitations.

SUMMARY OF THE INVENTION

The present invention is directed to an improved integrated hopper paintball marker. In accordance with one exemplary embodiment of the present invention, a paintball marker is provided using an integrated hopper located within the body of the marker that accepts a random orientation of paintballs and directs them to the loading chamber.

Of particular note is a marker body encasing both a launching device and a random orientation interior hopper. The unique construction uses an interior hopper compartment having a ramped bottom wall in proximity to the launching area. This is in contrast to the prior art that uses either a fixed orientation magazine, or a random orientation exterior hopper. Fixed orientation magazines take a long time to load such that they are not easily reloaded in the field. Random orientation exterior hoppers have bottom walls outside of the marker body such that the hopper is distal from the loading port. In contrast to the prior art, the present invention has a quick load interior magazine construction that lowers the center of gravity of the marker for increased accuracy. Further inventive aspects are found in the unique separation of the connection from the ball path area and in the angled nature of the connection so that the hopper may gravity direct paintballs to the loading port.

Also of note is the shortened length of the loading port that flowably connects the interior hopper compartment to the launch area.

Yet another advantage is found in the lower hopper compartment wall ramping upward from a position above the loading port.

A still further advantage is found in the marker body having a filling port for loading paintballs into the interior hopper compartment and a covering lid hinged to the marker body.

Another advantage is found in the interior hopper compartment having a hopper wall defining a bottom chute encouraging a serial arrangement of the paintballs.

One very unique advantage is found in the use of a hopper connector that provides for downwardly angling the interior hopper compartment toward the launch area.

Additional advantages are found in the hopper connector being adapted to secure the interior hopper compartment to the launching device in a flow prohibiting position that blocks the advancement of the paintball from the interior hopper compartment to the launch area and yet also providing a flowable position.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
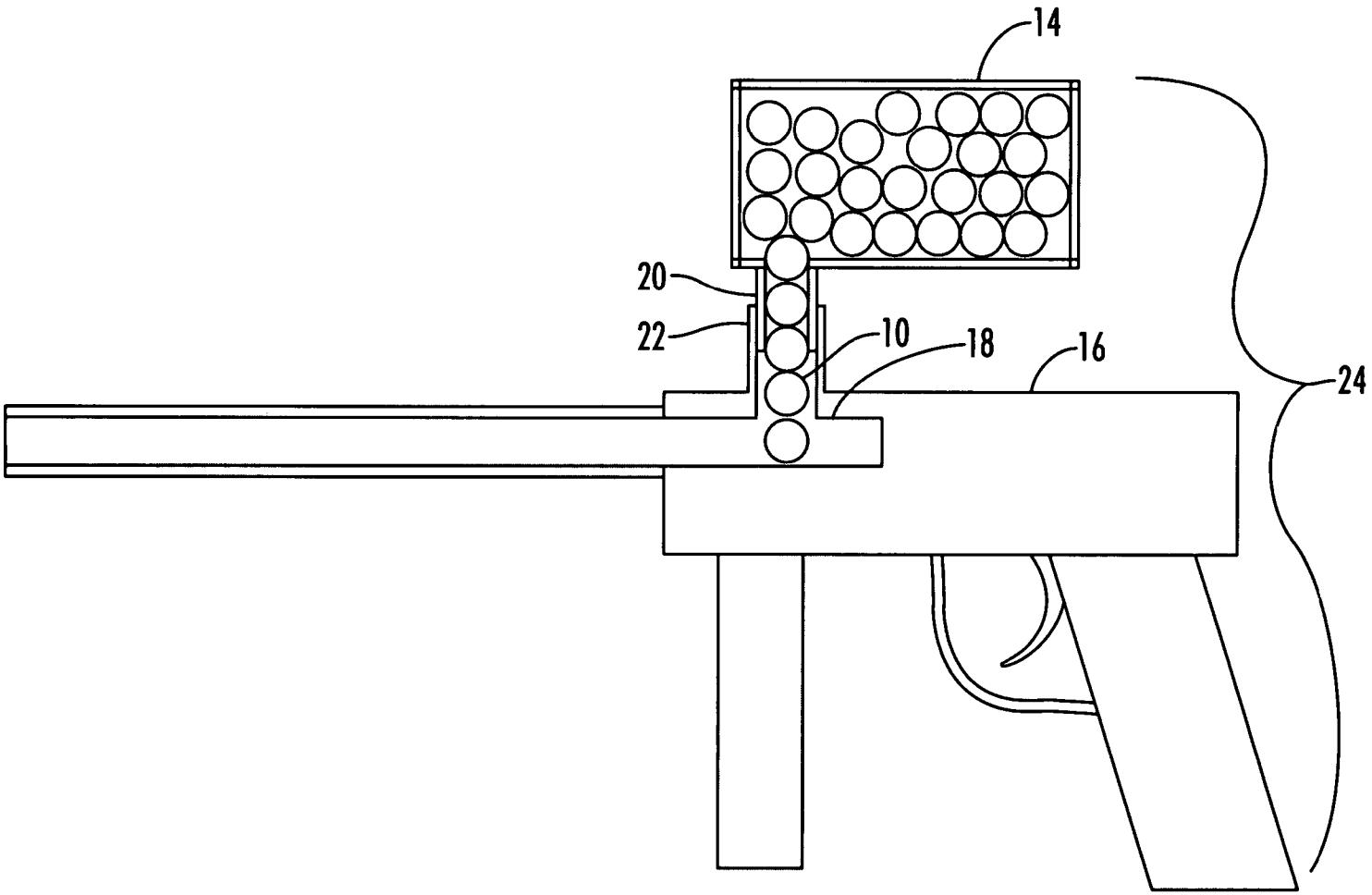
FIG. 1 (PRIOR ART)
FIG. 1 is a schematic view of a prior art paintball marker.
Figure 2:
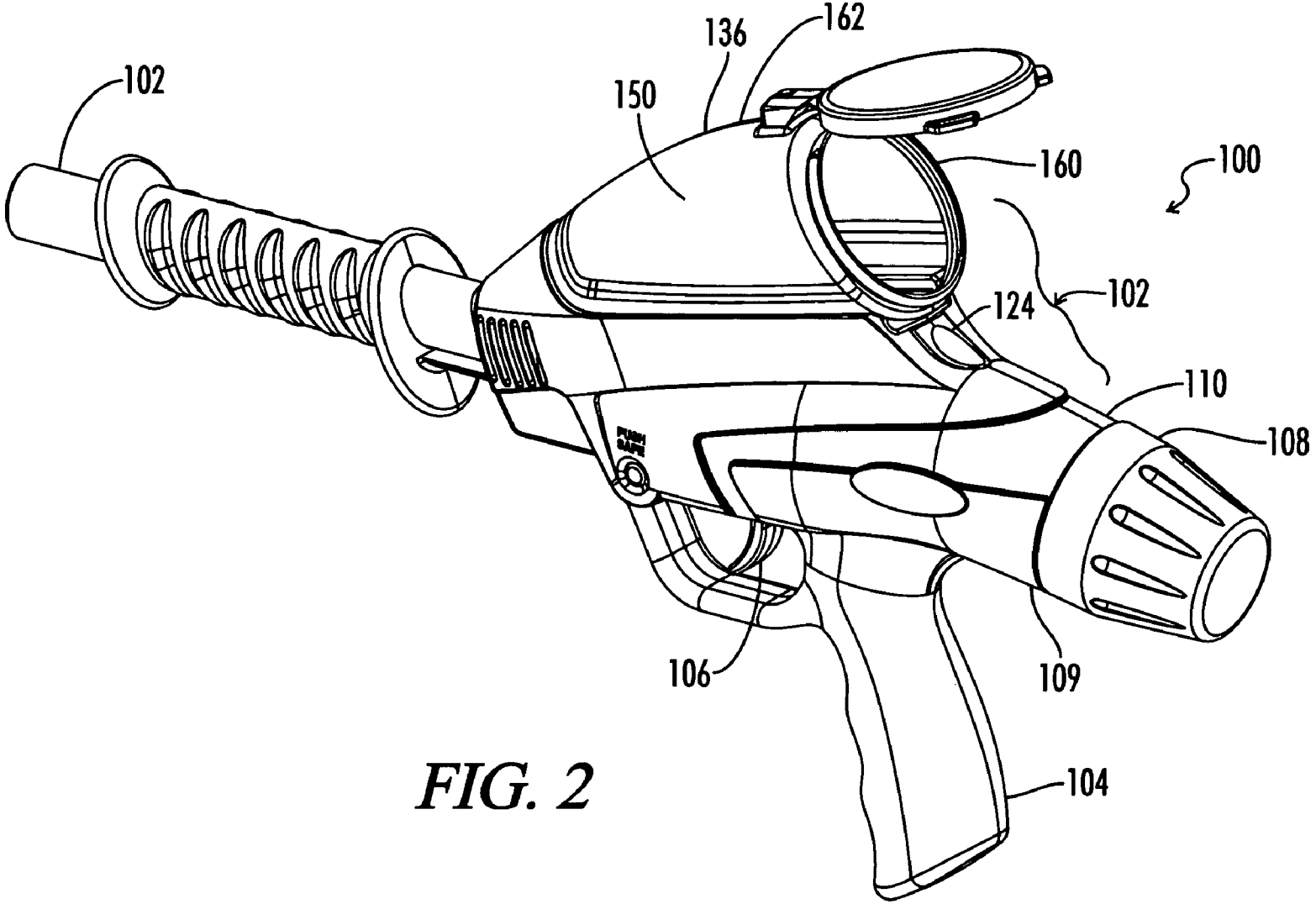
FIG. 2 shows an isometric view of an integrated hopper paintball marker.
Figure 3:
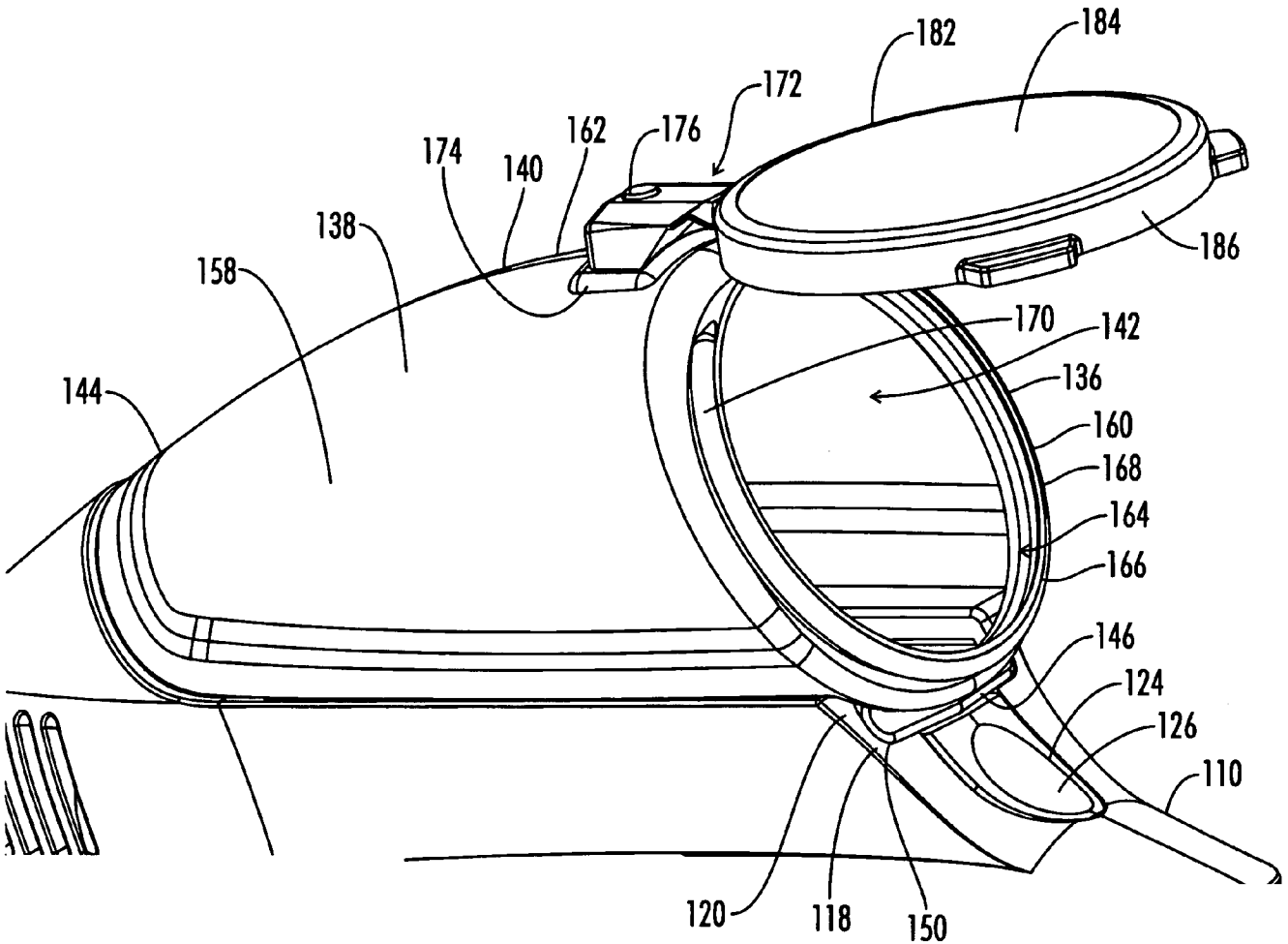
FIG. 3 shows an enlarged view of the integrated hopper mounted on the launching body.

As shown in FIGS. 2 through 16 of the drawings, one exemplary embodiment of the present invention is generally shown as an integrated paintball marker 100. The integrated paintball marker 100 has a marker body 102 including a launching body 110 and a random orientation integrated hopper 136. Several unique advantages are provided by the launching body 110 and the random orientation integrated hopper 136 of the present invention.

Figure 4:
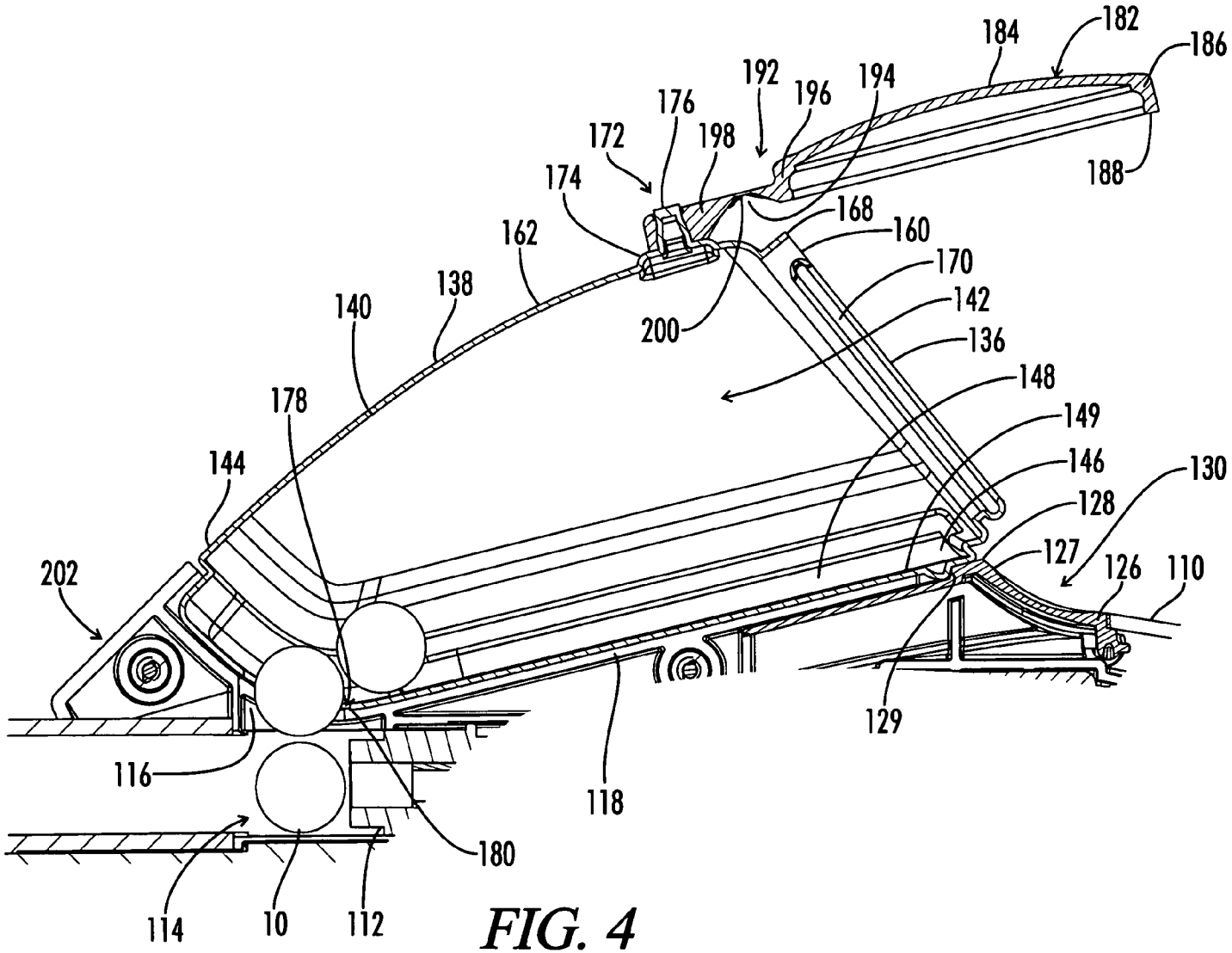
FIG. 4 shows a cut away view of the integrated hopper to body connection.
Figure 5:
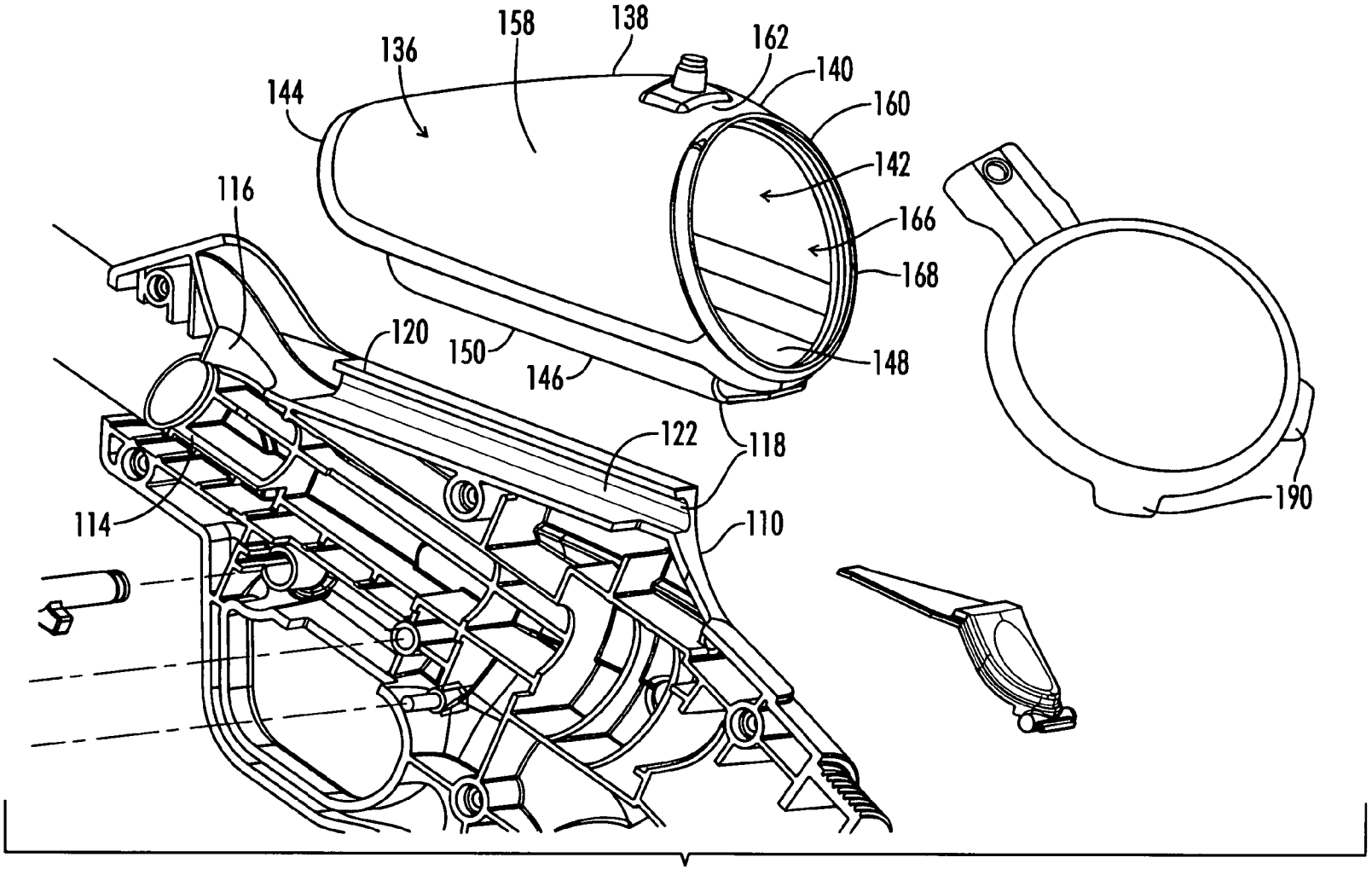
FIG. 5 shows an exploded view of one half of the launching body, the integrated hopper, the hopper lid, and the flexible lock catch.
Figure 6:
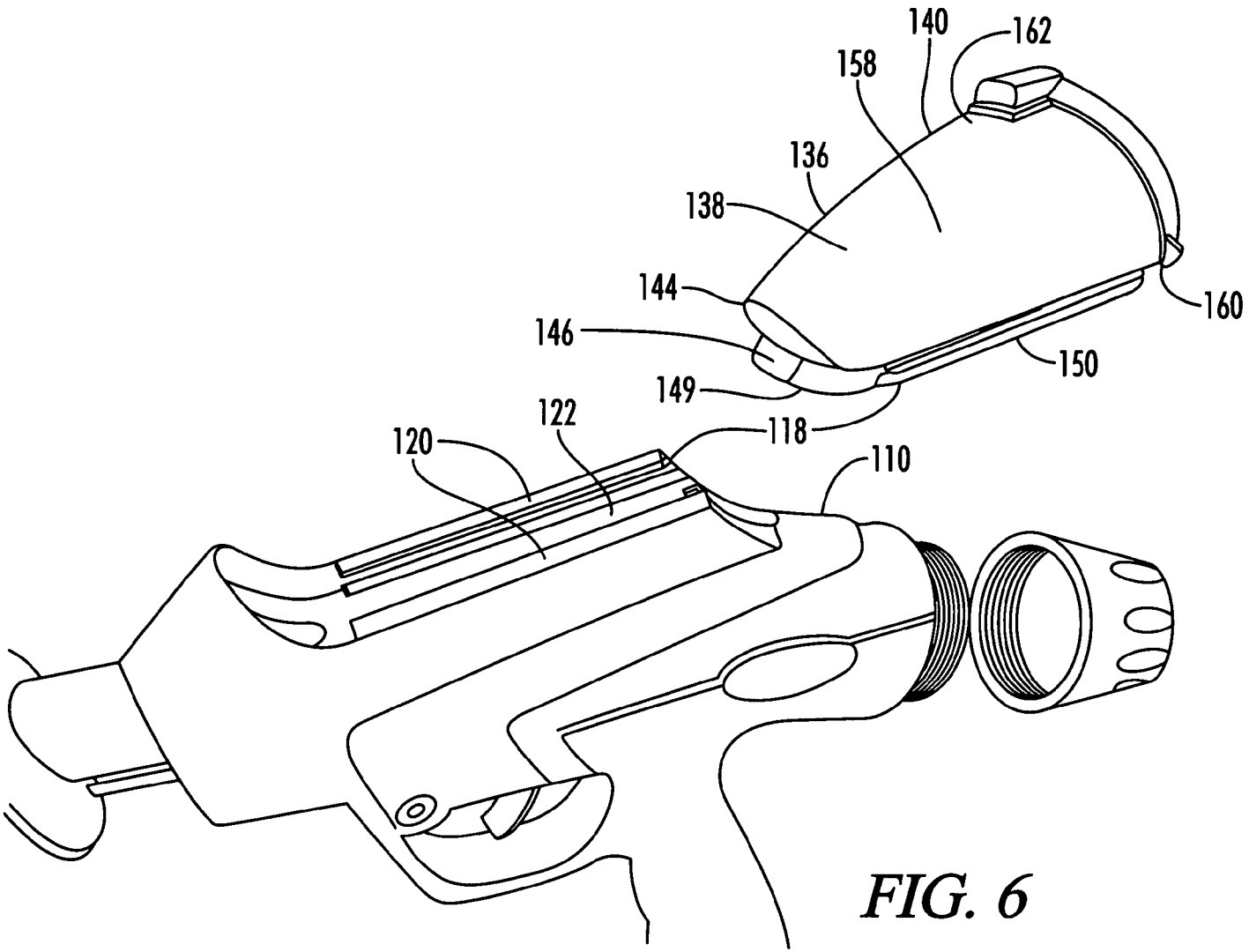
FIG. 6 shows an exploded view with the integrated hopper and pressure supply cover disconnected from the launching body.
Figure 7:
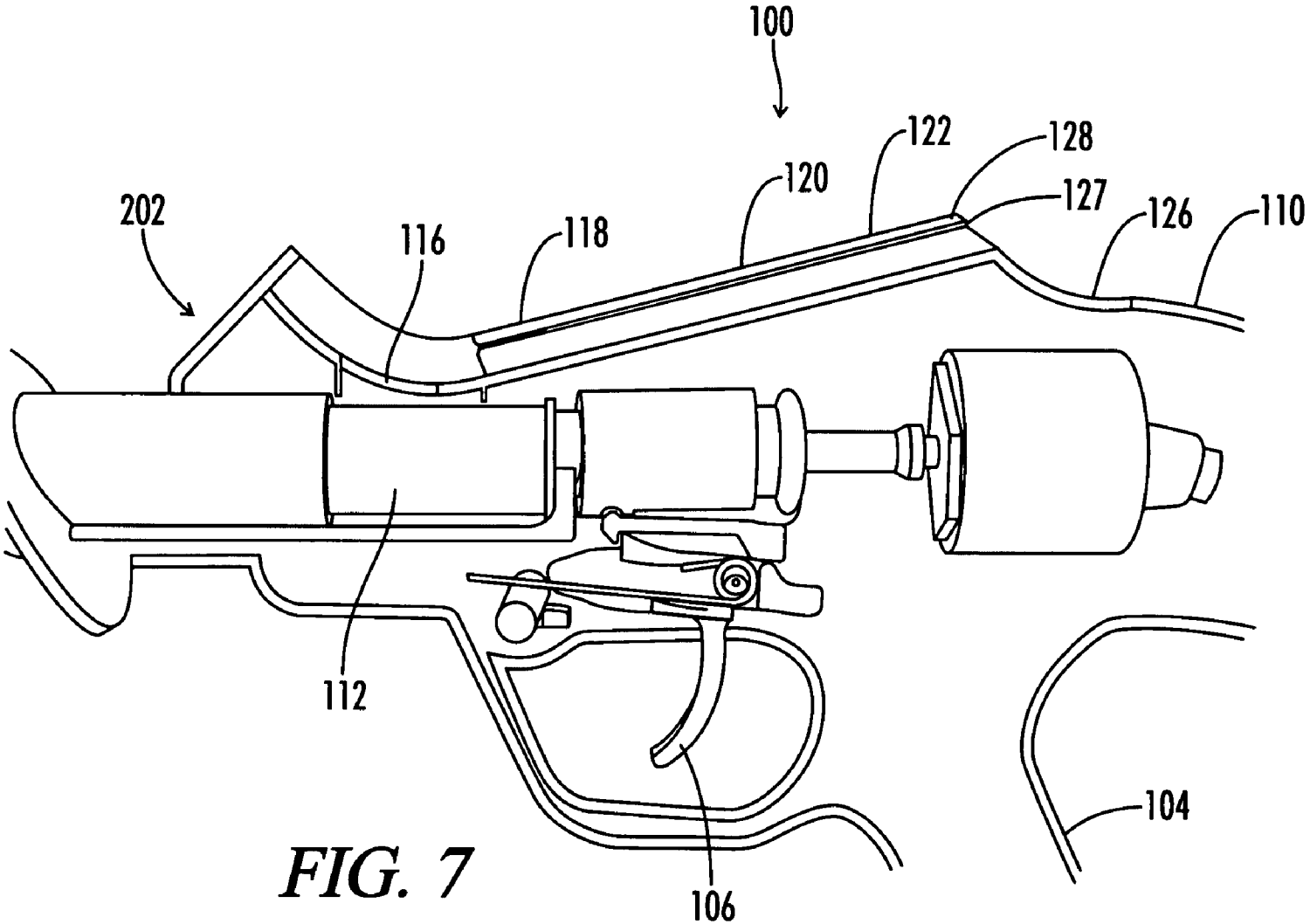
FIG. 7 shows a cutaway view of the launching body.
Figure 8:
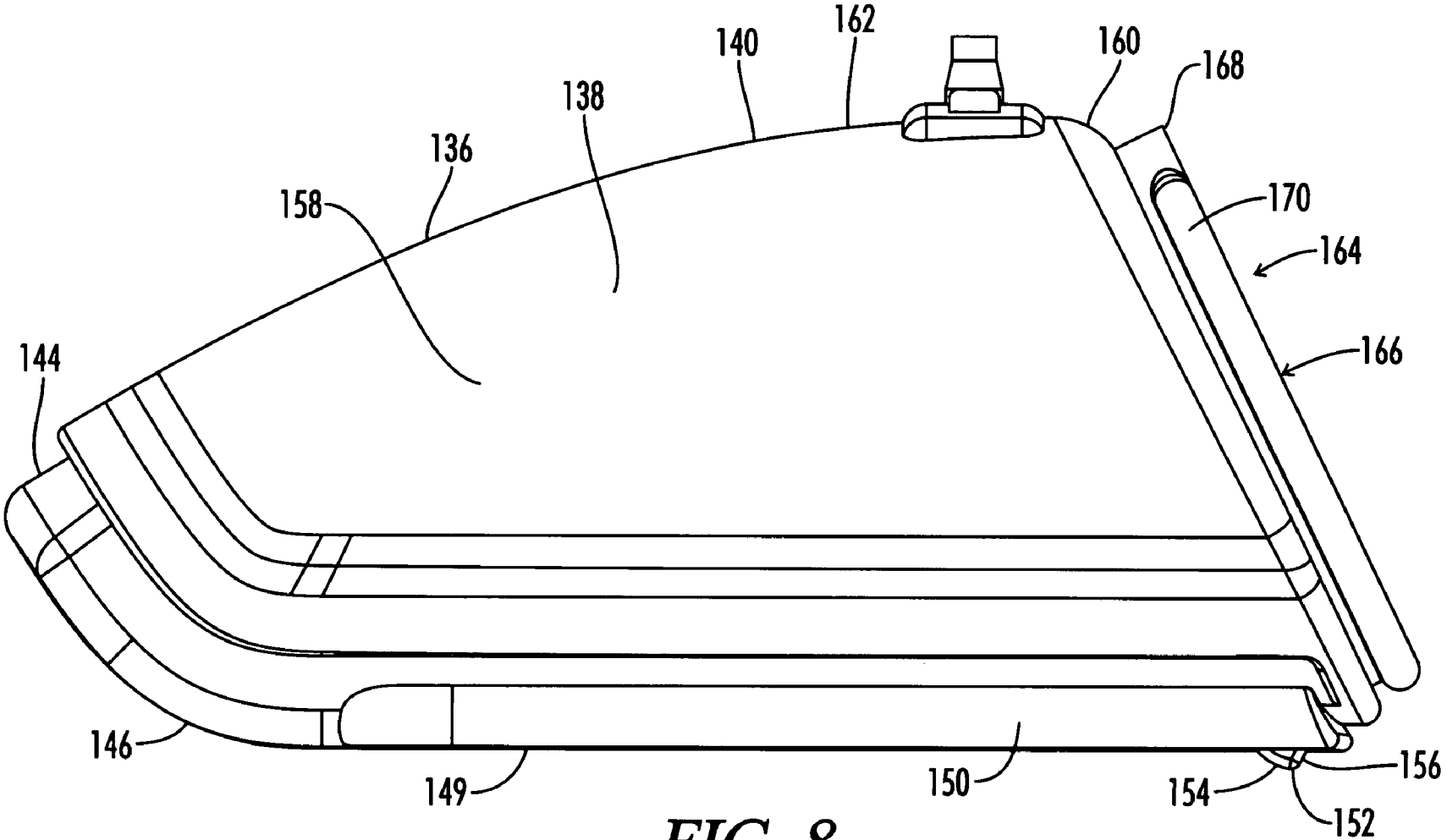
FIG. 8 shows a left side view of the integrated hopper body.
Figure 9:
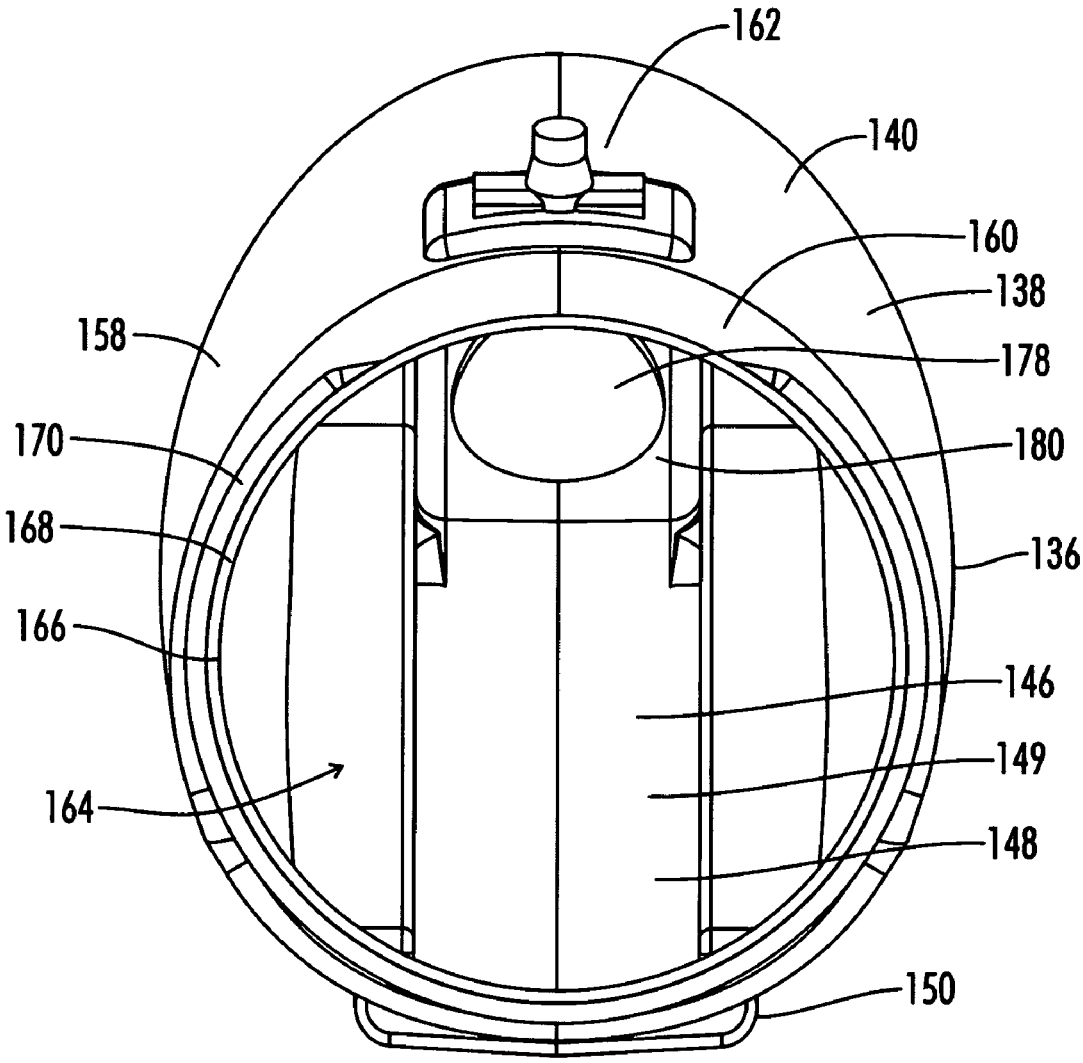
FIG. 9 shows a back view of the integrated hopper body.
Figure 10:
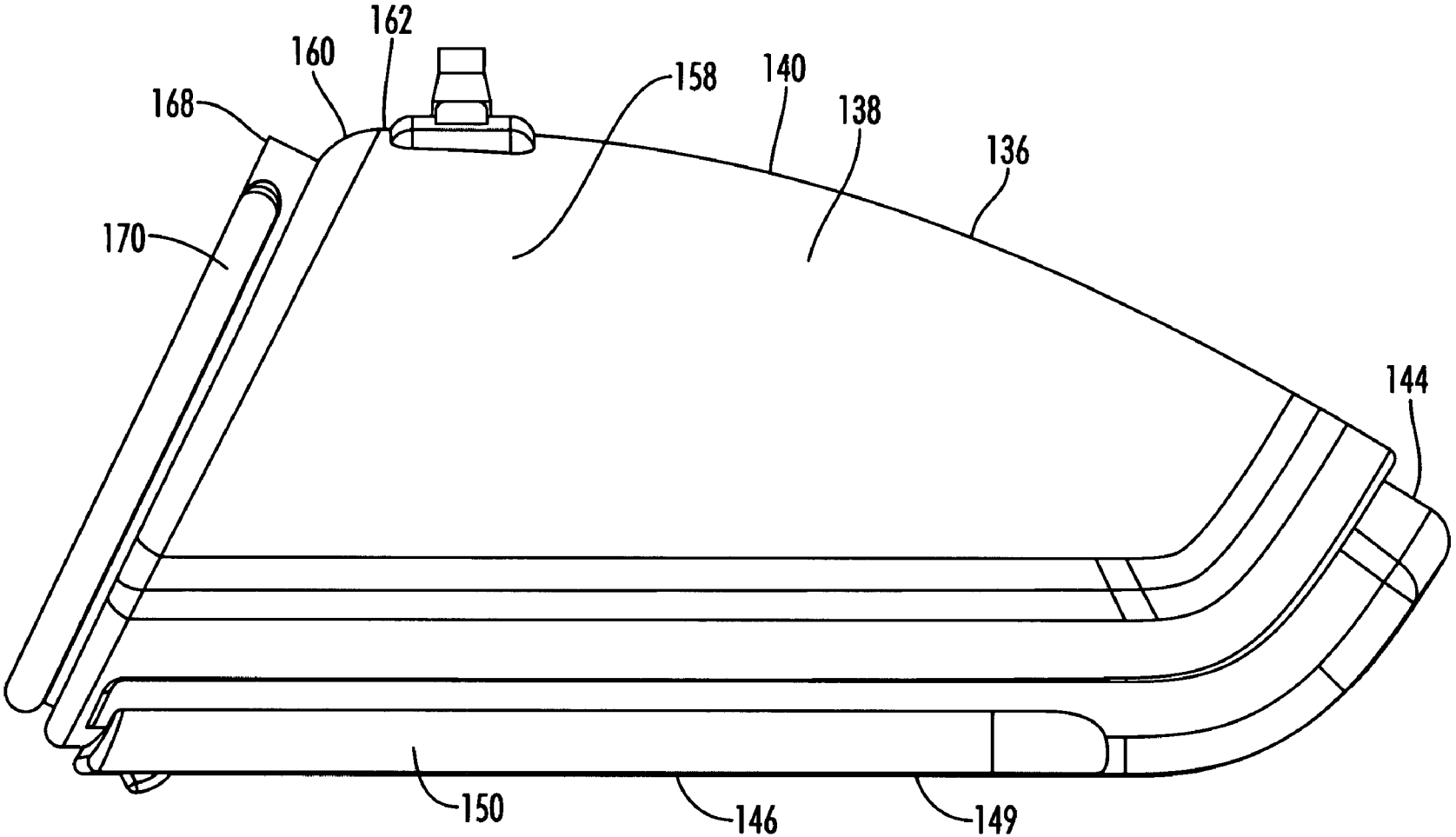
FIG. 10 shows a right side view of the integrated hopper body.
Figure 11:
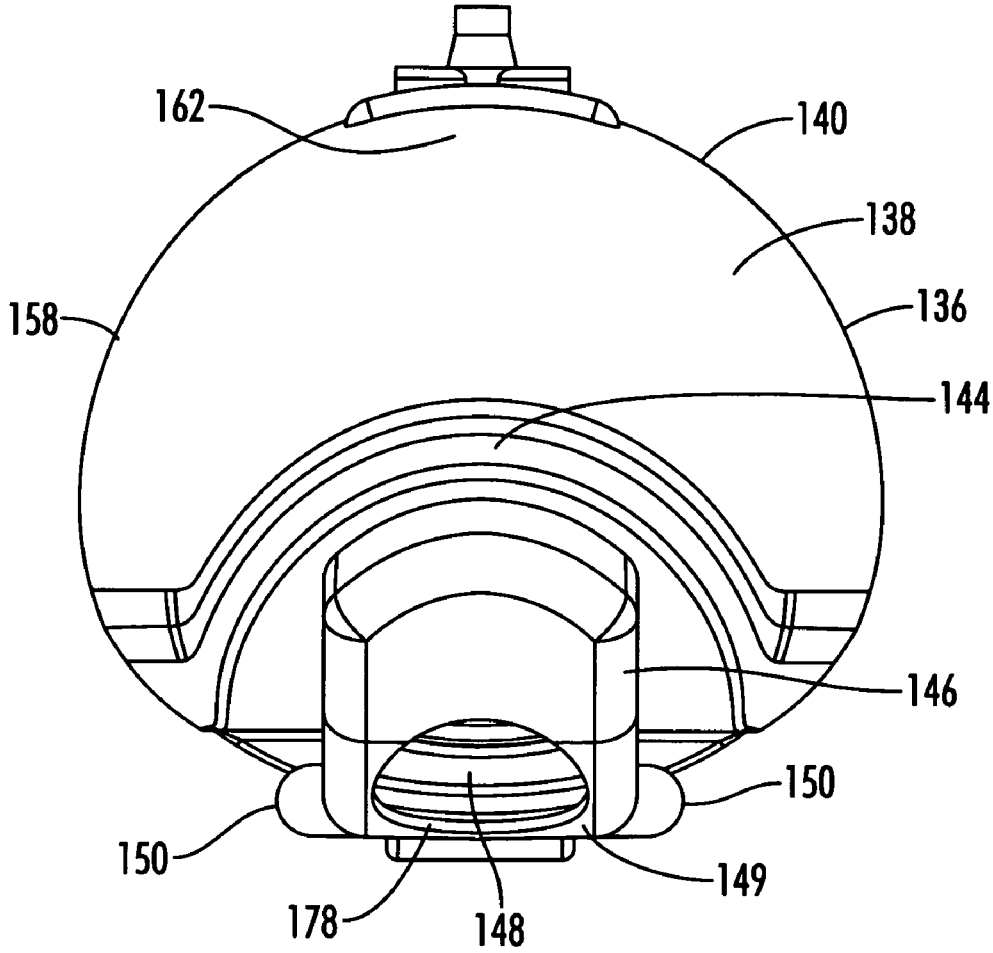
FIG. 11 shows a front view of the integrated hopper body.
Figure 12:
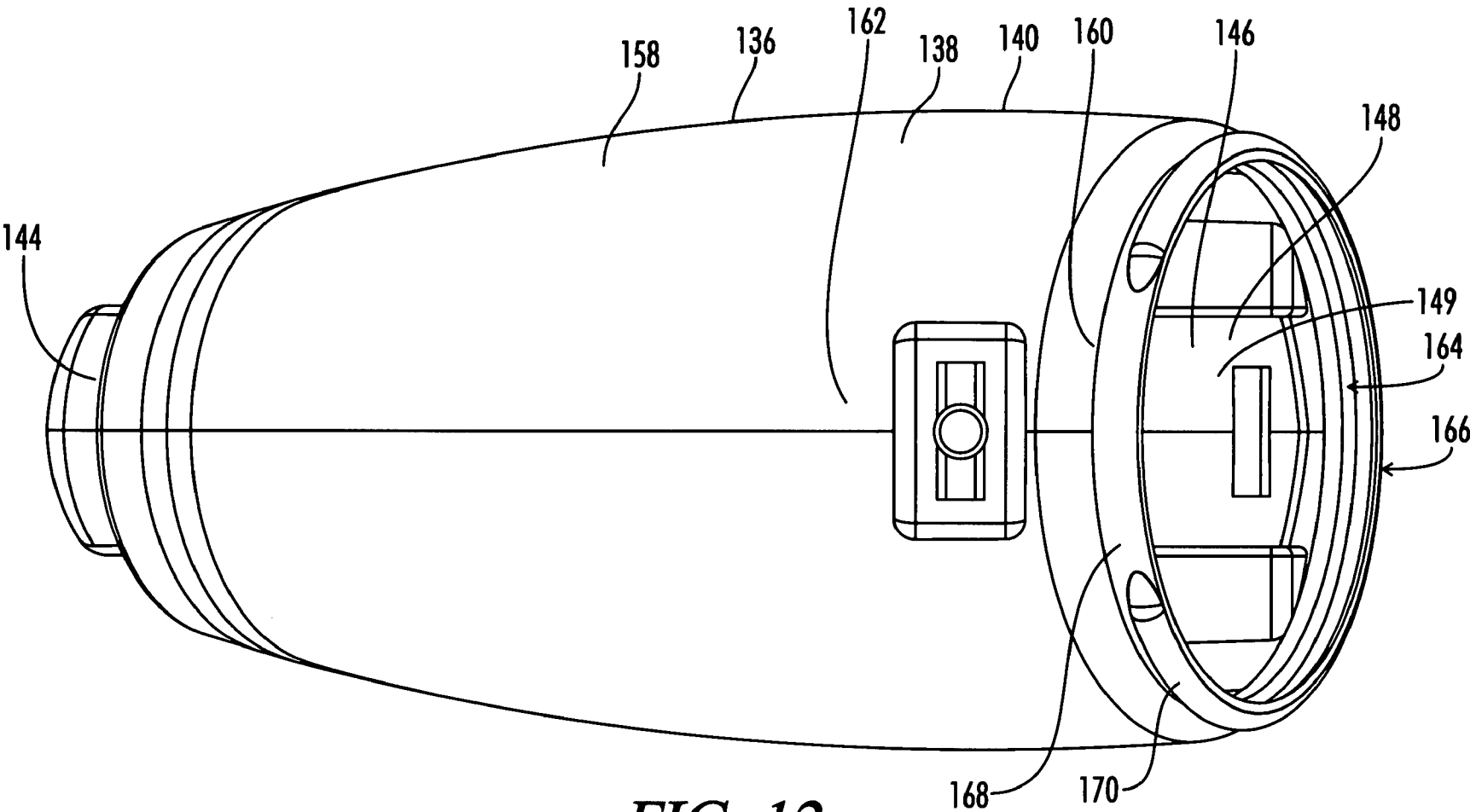
FIG. 12 shows a top side view of the integrated hopper body.
Figure 13:
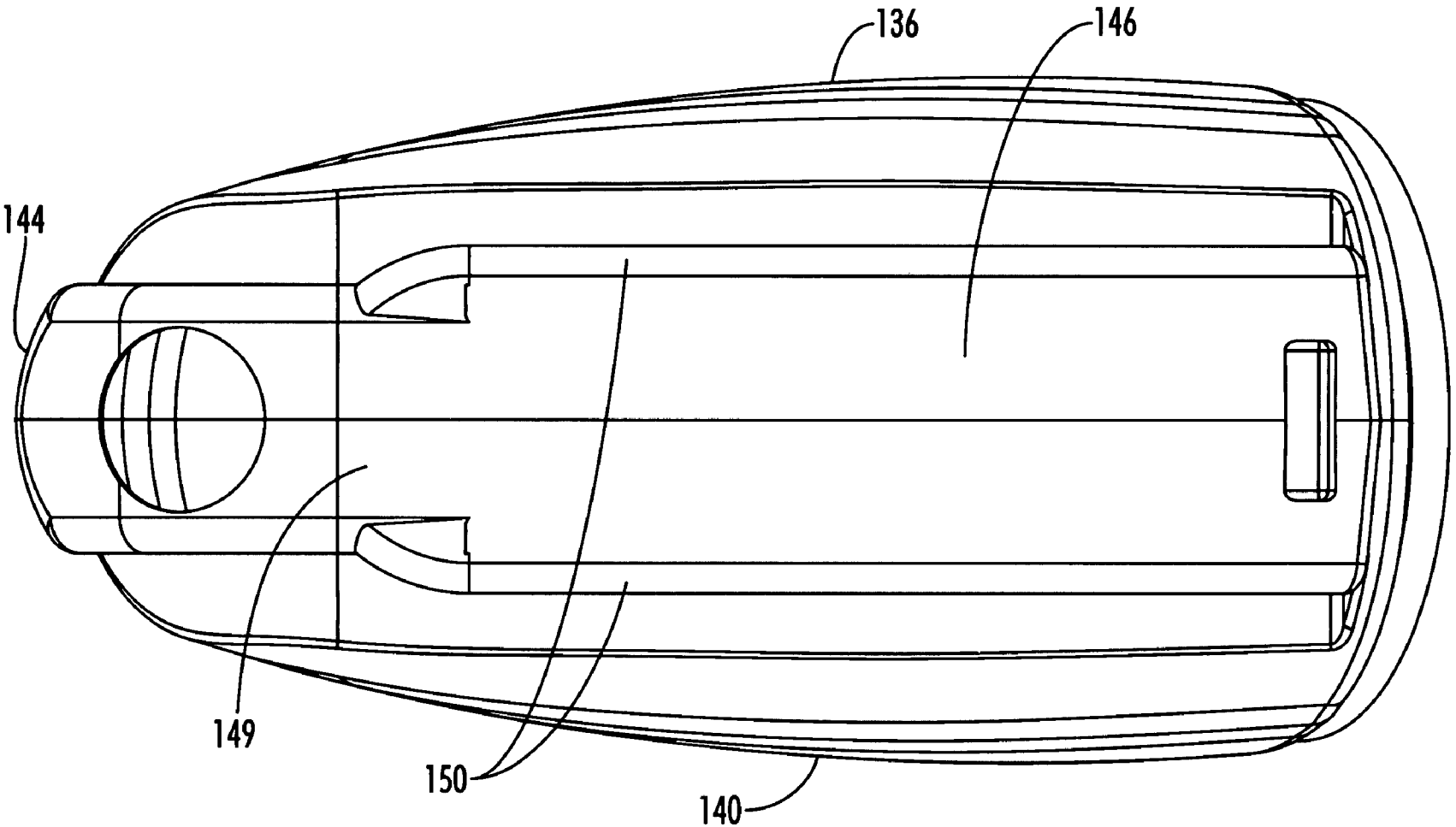
FIG. 13 shows a bottom view of the integrated hopper body.
Figure 14:
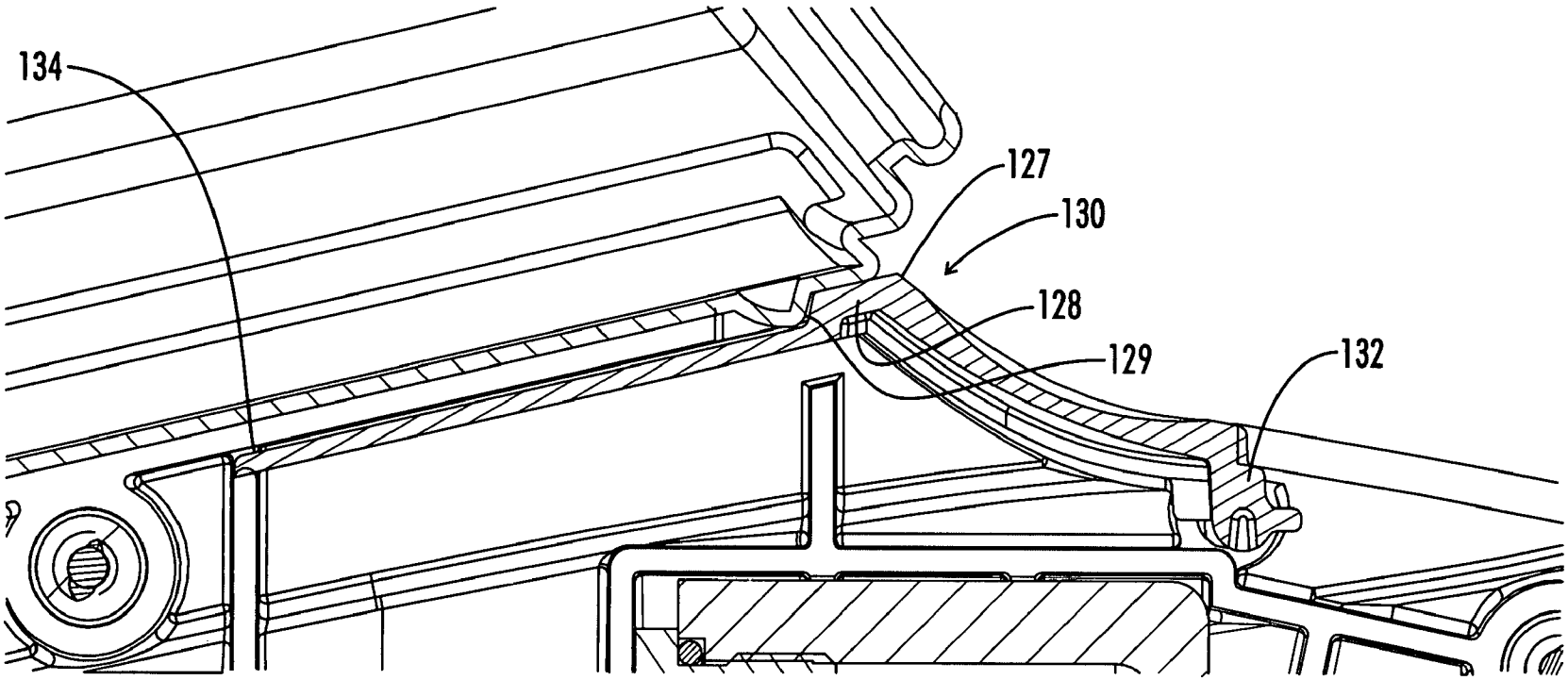
FIG. 14 shows a cutaway view of the lock in a raised position.
Figure 15:
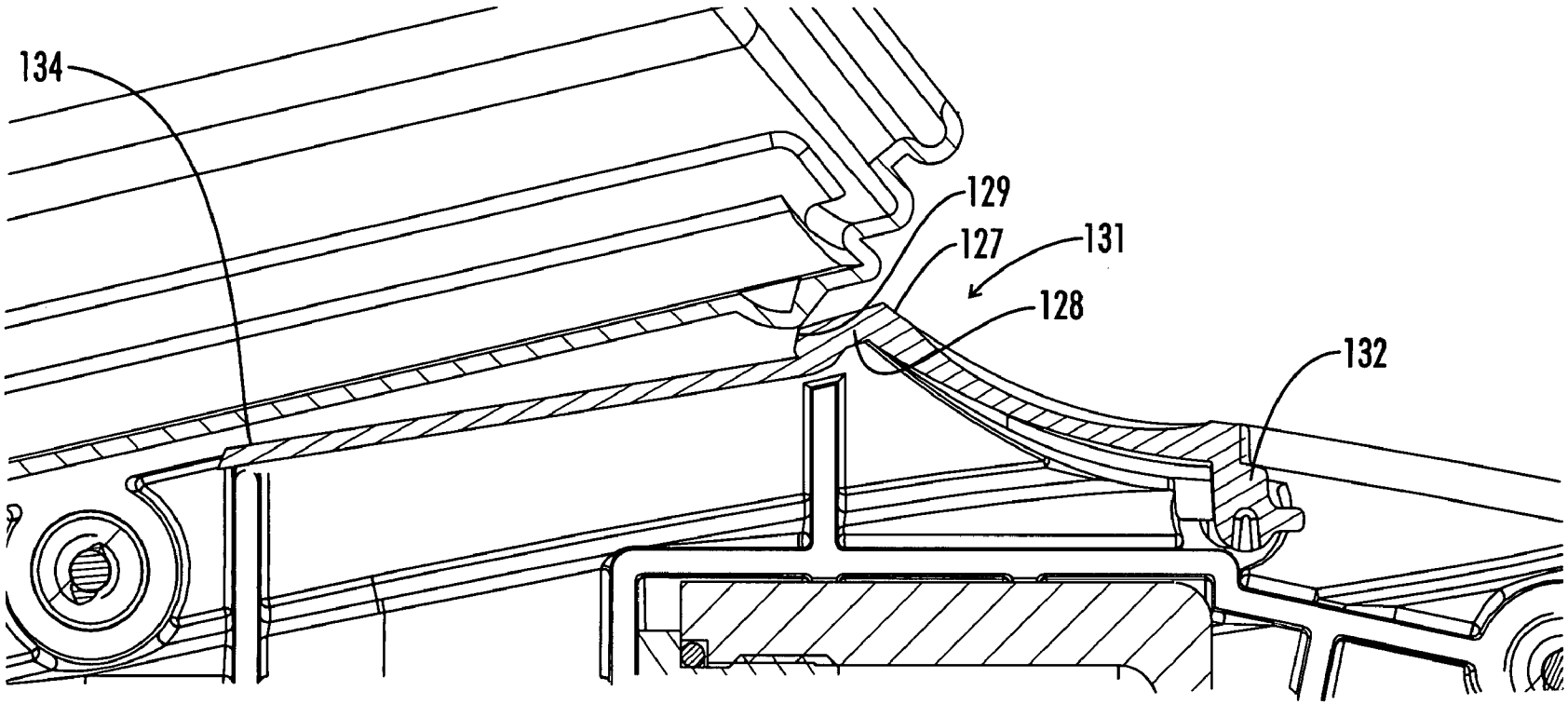
FIG. 15 shows a cutaway view of the lock in a lowered position.
Figure 16:
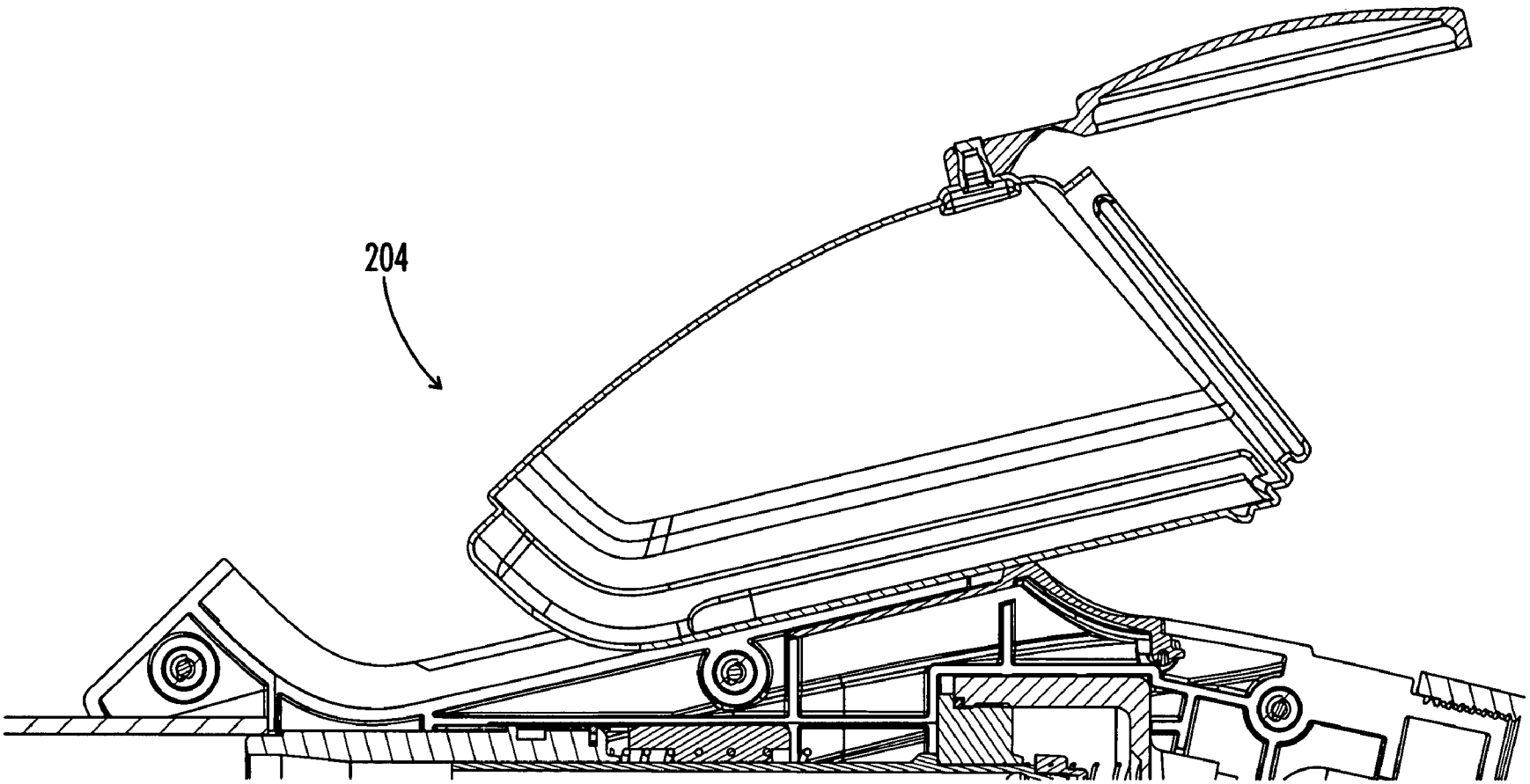
FIG. 16 shows a cutaway view of the hopper in a flow prohibiting position.

The launching body 110 includes a front barrel 102, a downward extending grip 104 housing a trigger 106, and a launching pressure supply 108 extending off of the back 109 of launching body 110. As shown in FIGS. 4, 5, and 7, the interior of the launching body 110 houses a launching device 112 adapted to launch a paintball 10 from a launching area 114. FIG. 5 provides a cutaway view with the launching device 112 removed for clarity of the launching area. The typical moving bolt and pressurized gas release launching device is adapted for use in this marker. Various other types of launching devices are well known as shown by the prior art patents that are incorporated into this specification. Thus, any of these different types of launching devices may be utilized and this invention is not meant to be limited to a particular type of launching device.

Paintballs 10 are loaded into the launching device 112 at the launching area 114 using a gravity feed from the random orientation integrated hopper 136 through a short length loading port 116. The present invention provides advantages in the preferred embodiment because the loading port 116 is less than the prior art's typical inch and half or more of length of the feed neck 20/22 above the bolt area 18 in most previous marker designs. Several unique approaches are also found in the construction of the gravity angled connection 118 and the random orientation integrated hopper 136 construction directing paintballs to this loading port 116.

The random orientation integrated hopper 136 is directly mounted to the launching body 110 using an angled sliding hopper connection 118. This is unique in both the integration of the random hopper 136 into the launching body 110 and the method of connecting the random hopper 136 to the launching body 110. Typical prior art hoppers that allow for quick load and random orientation use a completely separate hopper construction that is connected using the neck connection as previously noted. This results in the separate hopper 14 being located distally from the launching area 18. In contrast, the present invention provides a proximal placement of the bottom wall 149 of the quick load random hopper 136 in relation to the launching area 114. Furthermore, this invention provides unique characteristics by integrating the hopper 136 into the launching body 110 of the marker 100 such that the hopper 136 does not provide a catching type of extension above the marker 100. This sleek design reduces the projections so that the marker 100 does not have the tendency to catch on other items. This construction also lowers the center of gravity of the marker 100 for increased accuracy. Further inventive aspects are found in the unique separation of the connection 118 from the ball path area and in the angled nature of the connection 118 so that the hopper 136 may gravity direct paintballs 10 to the loading port 116.

The integrated interior hopper compartment 136 is constructed with a hopper wall 138 defining a body area 140 enclosing the containment area 142. The body area 140 has a front nose 144 and a bottom chute 146. The bottom chute 146 defines the ball guide 148 which directs the paintballs 10 to the exit area 178 defining the exit port 180 that releases the paintballs 10 from the hopper 136. The bottom chute 146 also has chute tabs 150 which engage the slide fingers 120 on the launching body 110.

The body area 140 has side walls 158, end wall 160, and the top wall 162 defining the shape of the body area 140. At the end wall 160 of the body area 140 is the filling area 164 which includes a filling port 166 defined by a port rim 168 having a catch lip 170. Note the large opening that provides for quick efficient random filling of this hopper. No known prior art design has integrated the random orientation hopper to provide this type of construction.

The top wall 162 has a connector area 172 with a hopper connector 174 using a connection post 176 to connect to the removable filling lid 182. The removable filling lid 182 has a spanning body 184 across a circular side rim 186. The side rim 186 has a catch lip 188 that engages the catch lip 170 on the filling port rim 168 to hold the lid 182 in a closed position. Release tabs 190 are provided at various locations around the filling lid 182 to allow the user to open the filing lid 182.

A lid connector 192 connects the filling lid 182 to the top wall 162. The lid connector 192 forms a hinge 194 by connecting a lid attachment 196 to the hopper attachment 198 using a flexible span 200. The lid attachment snaps onto the connection post 176 at the connector area 172.

The present invention uses a unique hopper 136 to launching body 110 construction that allows for movement of the hopper to provide for opening and blocking of the paintball path from the hopper's main compartment exit port 180 into the loading port 116 of the launching body 136. A flow allowance position 202 is provided when the exit port 180 and the loading port 116 are aligned. A flow prohibiting position 204 is provided when the exit port 180 and the loading port 116 are mis-aligned. These positions may be easily understood by reviewing the sliding nature chute tabs 150 and the slide finger 120 of the hopper connection 118.

The hopper connection uses chute tabs 150 on the random orientation integrated hopper 136 which engage the slide fingers 120 on the launching body 110. The set of slide fingers 120 are mounted above a slide base 122 to slidably engage the random orientation integrated hopper 136. Upon insertion of the random orientation integrated hopper 136 into the launching body 110, the random orientation integrated hopper 136 slides along the hopper connection 118 until the ramped edge 154 engages the exterior ramp 127 of the lock body 126. At this point, the friction of the slide 120/150 and the friction of the lock body 126 against the bottom of the chute 146 will hold the random orientation integrated hopper 136 in position so that the exit port 180 and the loading port 116 are mis-aligned. This allows the marker 100 to be carried with a full hopper 136 without the concerns of spilling paintballs 10 or an accidental launch of a ball 10 from the marker 100.

A simple forward push on the hopper 136 in relation to the launching body 110 will then overcome the friction of the slide 120/150 to put the hopper 136 in a flow allowance position 202 on the launching body 110. As shown in FIGS. 1 through 6, the launching body 110 houses a lock 124. The lock 124 has a flexible lock body 126 mounted using a rotatable lock support 132 and a sliding lock support 134. This allows the flexible lock body 126 to move between a raised position 130 and a lowered position 131. Upon insertion of the random orientation integrated hopper 136 into the launching body 110, the random orientation integrated hopper 136 slides along the hopper connection 118 until the ramped edge 154 engages the exterior ramp 127 of the lock body 126. Then, additional forward force on the random orientation integrated hopper 136 pushes on the ramped insertion edge 154 of the hopper lock extension 152 to flex the lock body 126 into the downward position 131 so that the random orientation integrated hopper 136 can continue its forward movement. Once the hopper lock extension 152 is past the locking extension 128 on the lock body 126, the catch edge 156 of the integrated hopper body 136 engages the blocking edge 129 of the flexible lock body 126 to hold the hopper 136 in position on the launching body 110. The exit port 180 and the loading port 116 are now aligned and the hopper 136 is in the flow allowance position 202. Also note that the angled nature of the sliding connection 118 provides for gravity feeding of the paintballs to the loading port 116.

The hopper 136 may be removed by pressing down on the lock body 126 to release the hopper lock extension 128 from the lock body 126. This allows for quick insertion and removable of the hopper body 136 from the launching body 110.

Reference numerals used throughout the detailed description and the drawings correspond to the following elements:

paintball 10
separate exterior hopper 14
separate paintball marker body 16
internal loading area 18
neck extension 20 external feed neck 22
expanded profile 24
integrated paintball marker 100
marker body 102
grip 104
trigger 106
launching pressure supply 108
back 109
launching body 110
launching device 112
launching area 114
loading port 116
hopper connection 118
slide fingers 120
slide base 122
lock 124
flexible lock body 126
exterior ramp 127
locking extension 128
blocking edge 129
raised position 130
lowered position 131
rotatable lock support 132
sliding lock support 134
random orientation integrated hopper 136
hopper wall 138
body area 140
containment area 142
front nose 144
bottom chute 146
ball guide 148
chute tabs 150
hopper lock extension 152
ramped insertion edge 154
catch edge 156
side walls 158
end wall 160
top wall 162
filling area 164
filling port 166
port rim 168
catch lip 170
connector area 172
hopper connector 174
connection post 176
exit area 178
exit port 180
filling lid 182
spanning body 184
side rim 186
catch lip 188
release tabs 190
lid connector 192
hinge 194
lid attachment 196
hopper attachment 198
flexible span 200
flow allowance position 202
flow prohibiting position 204

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

What is claimed is:

1. An integrated paintball marker apparatus adapted to launch a paintball the apparatus comprising:

a marker body defining a continuous undivided-lobe body shape encasing both a launching device defining a launching area and a removable interior hopper compartment having a bottom wall adjacent to the launching area, wherein the interior hopper compartment is adapted to hold a paintball load;

the marker body having an interior wall further defining a loading port flowably connecting the interior hopper compartment to the launch area such that the paintball may advanced from the interior hopper compartment to the launch area; and a hopper connector securing the interior hopper compartment to the launching device, the hopper connector adapted to secure the interior hopper compartment to the launching device using only the interior wall and the bottom wall to form a flow prohibiting position that blocks the advancement of the paintball from the interior hopper compartment to the launch area.

* * * * *